US006142888A

United States Patent [19]

Higuchi et al.

[11] Patent Number: 6,142,888

[45] Date of Patent: Nov. 7, 2000

[54] MULTI-PIECE SOLID GOLF BALL

[75] Inventors: Hiroshi Higuchi; Yasushi Ichikawa; Hisashi Yamagishi, all of Chichibu, Japan

[73] Assignee: Bridgestone Sports Co., Ltd., Tokyo, Japan

[21] Appl. No.: 09/268,662

[22] Filed: Mar. 16, 1999

[30] Foreign Application Priority Data

Mar. 16, 1998 [JP] Japan ..... 10-085028

[51] Int. Cl.[7] ..... A63B 37/06

[52] U.S. Cl. ..... 473/374

[58] Field of Search ..... 473/351, 374, 473/376

[56] References Cited

U.S. PATENT DOCUMENTS

| | | | |
|---|---|---|---|
| 5,184,828 | 2/1993 | Kim et al. | 473/374 |
| 5,704,854 | 1/1998 | Higuchi et al. | 473/374 X |
| 5,730,664 | 3/1998 | Asakura et al. | 473/374 X |
| 5,820,487 | 10/1998 | Nakamura et al. | 473/374 |
| 5,830,085 | 11/1998 | Higuchi et al. | 473/374 X |
| 5,899,822 | 5/1999 | Yamagishi et al. | 473/374 |
| 5,957,784 | 9/1999 | Asakura et al. | 473/374 |
| 5,967,907 | 10/1999 | Takemura et al. | 473/374 X |
| 5,967,908 | 10/1999 | Yamagishi et al. | 473/374 X |
| 5,980,396 | 11/1999 | Moriyama et al. | 473/376 |

FOREIGN PATENT DOCUMENTS

| | | |
|---|---|---|
| 4-244174 | 9/1992 | Japan . |
| 7-8301 | 2/1995 | Japan . |
| 2 168 059 | 6/1986 | United Kingdom . |
| 2 278 609 | 12/1994 | United Kingdom . |
| 2 316 328 | 2/1998 | United Kingdom . |
| 2 327 618 | 2/1999 | United Kingdom . |

*Primary Examiner*—John A. Ricci
*Attorney, Agent, or Firm*—Sughrue, Mion, Zinn, Macpeak & Seas, PLLC

[57] ABSTRACT

In a multi-piece solid golf ball comprising a solid core and a cover of at least two layers, one layer, preferably an inner layer, of the cover is formed mainly of a thermoplastic polyurethane elastomer having a JIS A hardness of 60–98 and a resilience of at least 40%. The golf ball is improved in spin properties, flight performance, feeling, durability, and mass-scale productivity.

12 Claims, No Drawings

MULTI-PIECE SOLID GOLF BALL

BACKGROUND OF THE INVENTION

1. Field of the Invention

This invention relates to a multi-piece solid golf ball having satisfactory flight performance, spin properties, feel, durability, and mass-scale productivity.

2. Prior Art

Two-piece solid golf balls are widely used. For amateur golfers, two-piece solid golf balls have the advantage of distance, but the disadvantages of a long run, difficulty of control, and a hard feel. The feel of two-piece solid golf balls can be softened by reducing the compression thereof, although this attempt sacrifices resilience and hence, flight distance.

One solution to overcome these drawbacks is to modify the ball structure into multi-piece solid golf balls. More particularly, the solid core portion is divided into two or more layers, and an appropriate hardness, specific gravity and diameter or gage are assigned to the respective layers.

However, prior art multi-piece solid golf balls still leave some problems to be solved with respect to their manufacturing process and lack mass-scale productivity. For example, in the case of three-piece solid golf balls consisting of a two-layer solid core and a cover, both the inner and outer layers of the solid core are formed of rubber compositions comprising polybutadiene, a metal salt of an unsaturated carboxylic acid and a peroxide. In preparing the solid core from these rubber compositions, the core inner layer is first formed by molding the inner layer composition under heat and pressure in accordance with a technique for forming the core of two-piece solid golf balls. The core inner layer is then enclosed within the core outer layer by preforming the outer layer composition into half shells in an unvulcanized or semi-vulcanized state, encasing the core inner layer in the shells, and molding them under heat and pressure. This process requires twice or more steps than the number of steps used in the manufacture of the core of conventional two-piece solid golf balls.

It is possible to mold and cure the rubber composition for the core outer layer by an injection molding technique. However, injection molding is impractical partially because polybutadiene and analogous rubber are poor in flow as is well known in the art, and partially because curing reaction is effected during molding so that the cycle time is prolonged.

Further, JP-A 244174/1992 discloses a three-piece golf ball comprising an elastomeric core, an intermediate layer, and a cover of thermoplastic material wherein the intermediate layer is formed of a thermoplastic resin composition containing at least 10% by weight, preferably at least 35% by weight of an amide block copolymer. JP-B 8301/1995 discloses a three-piece golf ball having an intermediate layer made of thermoplastic polyester elastomer. These golf balls, however, are still insufficient in spin properties. Especially the spin performance under a situation where large shear stresses are applied to the ball as on full shots with an iron is inferior, as compared with the above-mentioned multi-piece solid golf balls in which the solid core of two or more layers made of polybutadiene rubber base compositions is enclosed within the cover.

SUMMARY OF THE INVENTION

Therefore, an object of the invention is to provide a multi-piece solid golf ball which is improved in mass-scale productivity while its performance is at least comparable to prior art multi-piece solid golf balls in which the solid core of two or more layers made of polybutadiene rubber base compositions is enclosed within the cover.

The inventors have found that a multi-piece solid golf ball having a solid core enclosed within a cover of two or more layers is improved in performance over the prior art multi-piece solid golf balls by using a thermoplastic polyurethane elastomer having a JIS A hardness of 60 to 98 and a resilience of at least 40% in any one layer of the cover.

Polyurethane elastomers are very approximate to vulcanized rubber in that they have a very high elasticity despite a plastic base, and a great stress at tensile elongation as compared with polyamide and polyester elastomers. Under a situation where large shear stresses are applied to the ball as on full shots with an iron, the polyurethane elastomer cover permits the ball to be given a sufficient spin on iron shots so that the ball will stop as desired on the green. Especially when a polyurethane elastomer having specific viscoelastic properties is used, the golf ball will not receive severe impacts upon shots while maintaining appropriate rebound properties.

More specifically, thermoplastic polyurethane elastomers have an outstandingly high mechanical strength among various thermoplastic elastomers, and a great tensile stress at break as compared with other thermoplastic materials including amide block copolymers, known as thermoplastic polyamide elastomers, and thermoplastic polyester elastomers. Because of this nature, under a situation where large downward shear stresses are applied to the ball as on full shots with an iron, the ball with the polyurethane elastomer cover acquires a sufficient spin on iron shots so that the ball will stop as desired on the green. In contrast, when a cover is made of a material with a low stress, shear forces escape from the cover so that the ball may become unsusceptible to spin and difficult to control.

Therefore, using a thermoplastic polyurethane elastomer having specific viscoelastic properties as one cover layer provides a golf ball with the layer having the function of a shock absorber capable of absorbing severe impacts on shots while maintaining sufficient rebound properties.

The golf ball using the above-mentioned polyurethane elastomer in at least one layer, especially an inner layer of the multilayer cover is very durable and has performance at least comparable to the prior art multi-piece solid golf balls in which the solid core of two or more layers made of polybutadiene rubber base compositions is enclosed within the cover. As opposed to the rubber molding process including kneading, mold-filling or pre-molding, and vulcanizing steps, the molding process is simplified because molding is completed in one step. This provides great advantages in productivity and cost and ensures efficient mass-scale production.

Accordingly, the invention provides a multi-piece solid golf ball comprising a solid core and a cover of at least two layers, wherein any one layer of the cover is formed mainly of a thermoplastic polyurethane elastomer having a JIS A hardness of 60 to 98 and a resilience of at least 40%.

DETAILED DESCRIPTION OF THE INVENTION

The multi-piece solid golf ball of the invention has a solid core enclosed within a cover of at least two layers.

The solid core may be formed of a rubber composition comprising a base rubber, co-crosslinking agent, peroxide, and other additives. The core is typically formed by molding the rubber composition under heat and pressure.

The base rubber may be natural and/or synthetic rubber commonly used in prior art solid golf balls although 1,4-polybutadiene containing at least 40%, especially at least 90% of cis-structure is preferable. Another rubber component such as natural rubber, polyisoprene rubber or styrene-butadiene rubber may be blended with the polybutadiene rubber if desired. For high resilience, the base rubber should preferably contain at least 90% by weight of 1,4-polybutadiene having at least 90% of cis-structure.

In conventional solid golf balls, zinc and magnesium salts of unsaturated fatty acids such as methacrylic acid and acrylic acid and esters such as trimethylpropane trimethacrylate are used as the co-crosslinking agent. These compounds may be used herein although zinc acrylate is preferred because it can impart high resilience. The co-crosslinking agent is preferably used in an amount of about 10 to 30 parts by weight per 100 parts by weight of the base rubber.

Various peroxides are useful although dicumyl peroxide or a mixture of dicumyl peroxide and 1,1-bis(t-butylperoxy)-3,3,5-trimethylcyclohexane is appropriate. The amount of the peroxide blended is preferably about 0.5 to 1 part by weight per 100 parts by weight of the base rubber.

In the rubber composition, zinc oxide or barium sulfate are blended if necessary for adjusting the specific gravity. Anti-oxidants and other additives are also blended therein if desired.

In preparing the solid core from the rubber composition, the above-mentioned components are kneaded in a conventional mixer such as a kneader, Banbury mixer or roll mill, placed in a mold, and molded under appropriate heat and pressure, preferably at 145° to 160° C. The solid core is generally formed to a diameter of 26 to 40 mm, especially.30 to 37 mm. With a solid core diameter of less than 26 mm, the ball as a whole would not be sufficiently resilient. With a solid core diameter in excess of 40 mm, the ball would become less durable against shots. Preferably the solid core has a JIS C hardness of 40 to 80, more preferably 50 to 77, most preferably 55 to 77. If the core has a JIS C hardness of less than 40, the ball would become too soft and lose durability against shots and resilience. If the core has a JIS C hardness of more than 80, the ball would become too hard and poor in feel. For the same reason, it is preferred that the solid core have a deflection of 2.9 to 8.0 mm, especially 3.6 to 6.5 mm under a load of 100 kg.

Most often, the core is formed to a one-piece structure consisting of a single layer although it may be formed to a multilayer structure of two or more layers if desired.

According to the invention, the cover formed around the solid core is a multilayer cover including two or more layers. Any one layer, especially an inner layer of the cover is formed mainly of a thermoplastic polyurethane elastomer having a JIS A hardness of 60 to 98 and a resilience or repulsive elasticity of at least 40% as measured according to JIS K7311.

The thermoplastic polyurethane elastomer has a molecular structure including soft segments of a high molecular weight polyol, hard segments constructed of a monomolecular chain extender, and a diisocyanate.

The high molecular weight polyol compound is not critical and may be any of polyester polyols, polyol polyols, copolyester polyols, polycarbonate polyols and polyether polyols. The polyester polyols include polycaprolactone glycol, poly(ethylene-1,4-adipate) glycol, and poly (butylene-1,4-adipate) glycol. Typical of the copolyester polyols is poly(diethylene glycol adipate) glycol. One exemplary polycarbonate polyol is hexane diol-1,6-carbonate glycol. Polyoxytetramethylene glycol is typical of the polyether-polyols. These polyols have a number average molecular weight of about 600 to 5,000, preferably about 1,000 to 3,000.

The diisocyanates used herein include hexamethylene diisocyanate (HDI), tolylene diisocyanate (TDI), diphenylmethane diisocyanate (MDI), hydrogenated MDI ($H_{12}$MDI), IPDI, CHDI, and derivatives thereof. Of these, aliphatic diisocyanates are preferable, and HDI is most preferable for resilience although the diisocyanate component is not limited thereto.

The chain extender used herein is not critical and may be any of commonly used polyhydric alcohols and amines. Examples include 1,4-butylene glycol, 1,2-ethylene glycol, 1,3-propylene glycol, 1,6-hexylene glycol, 1,3-butylene glycol, dicyclohexylmethane diamine (hydrogenated MDA), and isophorone diamine (IPDA).

The thermoplastic polyurethane elastomer should have a JIS A hardness of 60 to 98, especially 70 to 95. Since thermoplastic polyurethane elastomers are characterized in that polymeric crystals bear hardness and modulus of elasticity, the resilience becomes higher as the hardness and modulus of elasticity become lower. Elastomers having a JIS A hardness of higher than 98 are unsuitable from the resilience aspect whereas elastomers having a JIS A hardness of less than 60 are too soft and difficult to mold despite high resilience.

Secondly, the thermoplastic polyurethane elastomer should have a resilience of at least 40%, especially 45 to 75% as measured according to JIS K7311. Elastomers with a resilience of less than 40% fail to provide the ball with sufficient rebound properties.

When the thermoplastic polyurethane elastomer is measured for viscoelasticity at 23° C., the elastomer preferably has a tanδ of 0.01 to 0.25, more preferably 0.03 to 0.2, most preferably 0.05 to 0.15. Further preferably, the thermoplastic polyurethane elastomer has a tanδ peak temperature of −5° C. or lower, more preferably −10° C. or lower, most preferably −20° C. or lower.

The term "tanδ peak temperature" is the temperature at which the elastomer exhibits a peak of tanδ and is one index of viscoelastic properties of the cover resin. The tanδ peak temperature is measured as follows. The elastomer is formed into a specimen having a thickness of 1.0 mm, a width of 12.0 to 12.7 mm, and a length of 30 to 35 mm. By means of a viscoelasticity spectrometer Dynamic Analyzer RDAII (Rheometrics Co.), the specimen is measured for loss elastic modulus and storage elastic modulus at a frequency of 10 Hz over a temperature range between −100° C. and +80° C. A value of tanδ is determined by dividing loss elastic modulus by storage elastic modulus. The value of tanδ at 23° C. is the value of tanδ at room temperature. The temperature at which the value of tanδ peaks is the tanδ peak temperature.

Elastomers having tanδ at 23° C. of less than 0.01 would have insufficient shock absorbing effect, and the feel of the ball when hit would leave more shock to the hands as compared with the elastomers having tans within the above-defined range. With tanδ at 23° C. of more than 0.25, the feel of the ball would not leave shock to the hands, but the ball would become very poorly resilient, leading to a reduced carry. If the tanδ peak temperature is higher than −5° C., the cover would become short of resilience, leading to a reduced carry.

Further preferably, the thermoplastic polyurethane elastomer has a tensile stress at break of at least 300 kg/cm$^2$, especially 310 to 700 kg/cm$^2$. With a tensile stress at break of less than 300 kg/cm$^2$, the ball would acquire less spin on short iron shots.

The thermoplastic polyurethane elastomer meeting the above requirements is commercially available under the trade name of Pandex T1188, T1190, T7890 and TR3080 from Dai-Nippon Ink & Chemicals K.K. and Ufine P580 and P590 from Asahi Glass K.K.

Another resin may be blended in the thermoplastic polyurethane elastomer for enhancing the effect and benefits of the invention. Examples of the other resin which can be blended include polyamide elastomers, polyester elastomers, ionomer resins, styrene block elastomers, hydrogenated polybutadiene, ethylene-vinyl acetate (EVA) copolymers, polycarbonates, polyacrylates, and polyamides. In addition to the resin component, various additives, for example, pigments, dispersants, antioxidants, UV-absorbers, and parting agents may be added in conventional amounts, if necessary.

Also metal compounds such as zinc oxide and barium sulfate, and metal powders such as titanium, lead and tungsten may be blended in the thermoplastic polyurethane elastomer for increasing the specific gravity.

In the practice of the invention, the layer formed mainly of the thermoplastic polyurethane elastomer is preferably an inner layer of the cover, especially the layer of the cover closely enclosing the solid core, for example, the intermediate layer of a three-piece solid golf ball.

In the golf ball according to the preferred embodiment of the invention, the thermoplastic polyurethane elastomer is used in the inner layer of the cover. In general, thermoplastic polyurethane elastomers have a greater specific gravity than polyamide elastomers and need not have blended therein large amounts of inorganic filler for specific gravity adjustment. Therefore, the provision of the cover inner layer of such attributes on the core does not offset the resilience of the core, but rather enables full advantage of the resilience of the core.

Also, since polyurethane elastomers have a greater tensile stress at break than polyamide elastomers and polyester elastomers, the elongation under application of a force of the same magnitude is smaller with polyurethane elastomers. For this reason, a golf ball using a polyurethane elastomer in its component, especially a cover inner layer undergoes a less energy loss and exhibits good spin properties when great shear stresses are applied as on full shots with a short iron club. Then the ball will quickly stop on the green.

The outermost layer of the cover may be formed of any desired material although it is preferably formed mainly of an ionomer resin, especially an ethylene-(meth)acrylic acid ionomer resin.

The ionomer resins used in the cover outermost layer, are preferably ethylene-(meth)acrylic acid ionomer resins having a flexural modulus of 200 to 600 MPa and a Shore D hardness of 50 to 75. Ionomer resins with a flexural modulus of less than 200 MPa or a Shore D hardness of less than 50 would be less resilient whereas ionomer resins with a flexural modulus in excess of 600 MPa or a Shore D hardness in excess of 75 would provide a poor feel and poor durability against repetitive shots. Ethylene-(meth)acrylic acid ionomer resins having a flexural modulus of 200 to 400 MPa and a Shore D hardness of 50 to 65 are most preferred.

The ionomer resins are commercially available under the trade name of Surlyn from E. I. dupont, Himilan from Du Pont-Mitsui Polychemicals Co., Ltd., and Iotek from Exxon Chemical.

In the practice of the invention, an adhesive layer may be interposed between the outermost layer of ionomer resin and the inner layer of thermoplastic polyurethane elastomer because further improvements in resilience and durability are expectable. Any of the adhesives which can firmly join the respective layers may be used. For example, epoxy resin adhesives, urethane resin adhesives, vinyl resin adhesives, and rubber adhesives are useful. Before the adhesive is applied to the inner layer, the surface of the inner layer may be roughened by a conventional technique. The thickness of the adhesive layer may be selected as appropriate although it is usually about 5 to 300 $\mu$m, especially about 10 to 100 $\mu$m thick.

The cover preferably has an overall thickness of 2.0 to 5.5 mm, especially 2.4 to 5.0 mm. The layer formed mainly of the thermoplastic polyurethane elastomer may have a thickness of 0.2 to 3.0 mm, especially 0.5 to 2.5 mm if it is an inner layer. The outermost layer formed mainly of the ionomer resin may have a thickness of 0.2 to 3.2 mm, more preferably 1.0 to 2.5 mm, especially 1.6 to 2.4 mm.

The solid core may be enclosed within the cover by a conventional injection molding process or a heat pressing process involving preforming half cups from the cover stock and encasing the core in the half cups, followed by molding under heat and pressure. Since both the thermoplastic polyurethane elastomer and the ionomer resin can be injection molded, both the cover layers can be formed by the injection molding process. Therefore, the multi-piece solid golf ball comprising a single solid core, a cover layer formed mainly of the thermoplastic polyurethane elastomer as an intermediate layer and another cover layer formed mainly of the ionomer resin as the outermost layer has high productivity, as compared with multi-piece solid golf balls comprising inner and outer cores made of rubber compositions and a cover, while it has satisfactory flight performance, spin properties, hitting feel and durability.

The golf ball of the invention is formed with a multiplicity of dimples in the cover surface. The geometrical arrangement of dimples may be octahedral, icosahedral or the like while the dimple pattern may be selected from square, hexagon, pentagon, and triangle patterns.

While the above construction is met, the solid golf ball of the invention may be formed so as to have a diameter of not less than 42.67 mm and a weight of not greater than 45.93 g in accordance with the Rules of Golf.

The multi-piece solid golf ball of the invention is improved in spin properties, flight performance, feeling, durability, and mass-scale productivity.

EXAMPLE

Examples of the invention are given below by way of illustration and not by way of limitation.

Examples 1–6 & Comparative Examples 1–3

Solid cores were prepared by kneading the core-forming rubber compositions shown in Tables 1 and 2 in a Banbury mixer and compression molding them at 155° C. for 15 minutes. The thermoplastic elastomer compositions shown in Tables 1 and 2 were injection molded around the cores to form inner layers, giving spheres.

Around the spheres, the ionomer resin compositions shown in Tables 1 and 2 were injection molded to form outermost layers, completing three-piece solid golf balls having a diameter of 42.7 mm.

Comparative Examples 4–5

Solid cores were prepared by kneading the core-forming rubber compositions shown in Tables 1 and 2 in a Banbury mixer and compression molding them at 155° C. for 15 minutes. The ionomer resin compositions shown in Tables 1 and 2 were injection molded around the cores to form covers, completing three-piece solid golf balls having a diameter of 42.8 mm.

TABLE 1

| Composition (pbw) | | | Example 1 | 2 | 3 | 4 | 5 | 6 |
|---|---|---|---|---|---|---|---|---|
| Core | | Polybutadiene rubber[1)] | 100 | 100 | 100 | 100 | 100 | 100 |
| | | Barium sulfate | 19.8 | 19.8 | 19.8 | 21.4 | 16.9 | 26.3 |
| | | Zinc acrylate | 27.4 | 27.4 | 27.4 | 27.4 | 27.4 | 27.4 |
| | | Zinc oxide | 5 | 5 | 5 | 5 | 5 | 5 |
| | | Antioxidant | 0.2 | 0.2 | 0.2 | 0.2 | 0.2 | 0.2 |
| | | Peptizer | 1. | 1 | 1 | 1 | 1 | 1 |
| | | Dicumyl peroxide | 1.2 | 1.2 | 1.2 | 1.2 | 1.2 | 1.2 |
| Cover | Inner layer | Thermoplastic polyurethane elastomer[2)] | 100 | — | — | — | 100 | — |
| | | Thermoplastic polyurethane elastomer[3)] | — | 100 | — | — | — | — |
| | | Thermoplastic polyurethane elastomer[4)] | — | — | 100 | — | — | — |
| | | Thermoplastic polyurethane elastomer[5)] | — | — | — | 100 | — | 70 |
| | | Himilan 8120[11)] | — | — | — | — | — | 30 |
| | | Tungsten | — | — | — | — | 4.5 | — |
| | | Specific gravity | 1.19 | 1.19 | 1.19 | 1.16 | 1.24 | 1.08 |
| | | JIS A hardness | 81 | 92 | 98 | 86 | 90 | 90 |
| | | Resilience (%) | 58 | 48 | 40 | 67 | 50 | 61 |
| | | Tensile strength at break (kg/cm$^2$) | 350 | 450 | 500 | 330 | 320 | 320 |
| | | tanδ at 23° C. | 0.08 | 0.13 | 0.13 | 0.03 | 0.08 | 0.07 |
| | | tanδ peak temperature (° C.) | −20 | −15 | −10 | −38 | −20 | −38 |
| | Outer layer | Himilan 1706[6)] | 50 | 50 | 50 | 50 | 50 | 50 |
| | | Himilan 1605[7)] | 50 | 50 | 50 | 50 | 50 | 50 |
| | | Titanium dioxide | 5 | 5 | 5 | 5 | 5 | 5 |
| | | Magnesium stearate | 0.4 | 0.4 | 0.4 | 0.4 | 0.4 | 0.4 |
| | | Ultramarine | 0.02 | 0.02 | 0.02 | 0.02 | 0.02 | 0.02 |

TABLE 2

| Composition (pbw) | | | Comprative Example 1 | 2 | 3 | 4 | 5 |
|---|---|---|---|---|---|---|---|
| Core | | Polybutadiene rubber[1)] | 100 | 100 | 100 | 100 | 100 |
| | | Barium sulfate | 26.3 | 30.4 | 26.3 | — | — |
| | | Zinc acrylate | 27.4 | 27.4 | 27.4 | 25 | 35 |
| | | Zinc oxide | 5 | 5 | 5 | 23 | 18.9 |
| | | Antioxidant | 0.2 | 0.2 | 0.2 | 0.2 | 0.2 |
| | | Peptizer | 1 | 1 | 1 | 0.2 | 0.2 |
| | | Dicumyl peroxide | 1.2 | 1.2 | 1.2 | 0.8 | 0.8 |
| Cover | Inner layer | Thermoplastic polyurethane elastomer[8)] | 100 | — | — | | |
| | | Thermoplastic polyurethane elastomer[9)] | — | 100 | — | | |
| | | Thermoplastic polyurethane elastomer[10)] | — | — | 100 | | |
| | | Specific gravity | 1.08 | 1.01 | 1.08 | | |
| | | JIS A hardness | 90 | 83 | 80 | | |
| | | Resilience (%) | 15 | 68 | 78 | | |
| | | Tensile strength at break (kg/cm$^2$) | 500 | 280 | 130 | | |
| | | tanδ at 23° C. | 0.38 | 0.03 | 0.03 | | |
| | | tanδ peak temperature (° C.) | 32 | −40 | −48 | | |

TABLE 2-continued

| Composition (pbw) | | Comprative Example 1 | 2 | 3 | 4 | 5 |
|---|---|---|---|---|---|---|
| Outer layer | Himilan 1706[6)] | 50 | 50 | 50 | 50 | 50 |
| | Himilan 1605[7)] | 50 | 50 | 50 | 50 | 50 |
| | Titanium dioxide | 5 | 5 | 5 | 5 | 5 |
| | Magnesium stearate | 0.4 | 0.4 | 0.4 | 0.4 | 0.4 |
| | Ultramarine | 0.02 | 0.02 | 0.02 | 0.02 | 0.02 |

Note:
1) BR01 by Nippon Synthetic Rubber
2) Pandex T1180 by Dai-Nippon Ink & Chemicals K.K.
3) Pandex T1190 by Dai-Nippon Ink & Chemicals K.K.
4) Pandex T1198 by Dai-Nippon Ink & Chemicals K.K.
5) Pandex TR3080 by Dai-Nippon Ink & Chemicals K.K.
6) Zn ethylene-methacrylic acid ionomer resin by Du Pont-Mitsui Polychemicals Co., Ltd.
7) Na ethylene-methacrylic acid ionomer resin by Du Pont-Mitsui Polychemicals Co., Ltd.
8) Pandex EX-PE90A by Dai-Nippon Ink & Chemicals K.K.
9) Pebax 3533SA by Toray K.K.
10) Hytrel 3078 by Toray-dupont K.K.
11) Na ethylene-methacrylic acid-acrylate ionomer resin by E. I. duPont
Resilience and tensile strength at break were measured according to JIS K7311.

The golf balls were examined for hardness, feel, flight distance, and iron properties.

Hardness

Hardness is expressed by a deflection of a core or ball under a load of 100 kg. Greater values indicate softer cores or balls.

Flexural modulus

The material of which the cover outer layer was made was formed into a 3-mm thick sheet. The sheet set at a span of 48 mm was measured for flexural modulus at a pressing rate of 1.3 mm/min according to ASTM D790

Feel

Professional golfers hit balls with a driver. The balls were rated "◎" for very good feeling, "O" for ordinary feeling, and "X" for poor feeling.

Driver test

Using a swing robot, the ball was hit with a driver at a head speed of 45 mls. A spin rate, carry and total distance were measured.

Iron test

Also using the swing robot, the ball was hit with a No. 9 iron (I#9) at a head speed of 36 mls. A spin rate was measured.

The results are shown in Tables 3 and 4.

TABLE 3

| | | Example 1 | 2 | 3 | 4 | 5 | 6 |
|---|---|---|---|---|---|---|---|
| Core | Outer diameter (mm) | 34.6 | 34.6 | 34.6 | 34.6 | 34.6 | 34.6 |
| | Hardness (mm) | 3.8 | 3.8 | 3.8 | 3.8 | 3.8 | 3.8 |
| Cover | Inner layer gage (mm) | 1.6 | 1.6 | 1.6 | 1.6 | 1.6 | 1.6 |
| | Inner layer hardness (JIS A) | 81 | 92 | 98 | 86 | 90 | 90 |
| | Outer layer gage (mm) | 2.4 | 2.4 | 2.4 | 2.4 | 2.4 | 2.4 |
| | Outer layer hardness (Shore D) | 63 | 63 | 63 | 63 | 63 | 63 |
| | Outer layer flexural modulus (Mpa) | 390 | 390 | 390 | 390 | 390 | 390 |
| Golf ball | Outer diameter (mm) | 42.7 | 42.7 | 42.7 | 42.7 | 42.7 | 42.7 |
| | Weight (g) | 45.3 | 45.3 | 45.3 | 45.3 | 45.3 | 45.3 |
| | Hardness (mm) | 3.2 | 3.0 | 2.8 | 3.1 | 3.0 | 3.0 |
| | Hitting feel | ◎ | ◎ | ◎ | ◎ | ◎ | ◎ |
| | Driver spin (rpm) | 2548 | 2670 | 2750 | 2550 | 2670 | 2680 |
| | Driver carry (m) | 208.0 | 207.5 | 208.0 | 209.0 | 207.2 | 207.5 |
| | Driver total (m) | 221.0 | 221.2 | 220.5 | 222.5 | 220.8 | 221.0 |
| | I#9 spin (rpm) | 8335 | 8500 | 8700 | 8340 | 8500 | 8500 |

TABLE 4

| | | Comparative Example | | | | |
|---|---|---|---|---|---|---|
| | | 1 | 2 | 3 | 4 | 5 |
| Core | Outer diameter (mm) | 34.6 | 34.6 | 34.6 | 38.5 | 38.5 |
| | Hardness (mm) | 3.8 | 3.8 | 3.8 | 4.1 | 2.7 |
| Cover | Inner layer gage (mm) | 1.6 | 1.6 | 1.6 | | |
| | Inner layer hardness (JIS A) | 90 | 83 | 80 | | |
| | Outer layer gage (mm) | 2.4 | 2.4 | 2.4 | 2.1 | 2.1 |
| | Outer layer hardness (Shore D) | 63 | 63 | 63 | 63 | 63 |
| | Outer layer flexural modulus (Mpa) | 390 | 390 | 390 | 390 | 390 |
| Golf ball | Outer diameter (mm) | 42.7 | 42.7 | 42.7 | 42.7 | 42.7 |
| | Weight (g) | 45.3 | 45.3 | 45.3 | 45.3 | 45.3 |
| | Hardness (min) | 3.0 | 3.2 | 3.3 | 3.0 | 2.2 |
| | Hitting feel | ⊙ | ○ | ○ | ○ | X |
| | Driver spin (rpm) | 2675 | 2550 | 2510 | 2750 | 2800 |
| | Driver carry (m) | 200.2 | 207.5 | 206.5 | 206.4 | 206.0 |
| | Driver total (m) | 214.1 | 219.5 | 219.7 | 219.0 | 219.0 |
| | I#9 spin (rpm) | 8500 | 8010 | 7820 | 7900 | 8600 |

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multi-piece solid golf ball comprising a solid core and a cover of at least two layers, wherein any one layer of the cover is formed mainly of a thermoplastic polyurethane elastomer having a JIS A hardness of 60 to 98 and a resilience of at least 40%.

2. The golf ball of claim 1 wherein the thermoplastic polyurethane elastomer has a tanδ of 0.01 to 0.25 as determined from viscoelasticity measurement at 23° C.

3. The golf ball of claim 1 wherein the thermoplastic polyurethane elastomer has a tensile stress at break of at least 300 kg/cm$^2$.

4. The golf ball of claim 1 wherein the thermoplastic polyurethane elastomer exhibits a peak of tanδ at a temperature of up to −5° C. during viscoelasticity measurement.

5. The golf ball of claim 1 wherein said solid core has been formed by heat curing a rubber composition comprising polybutadiene rubber, zinc acrylate and a peroxide and has an outer diameter of 26 to 37 mm.

6. The golf ball of claim 1 wherein the outermost layer of said cover is formed mainly of an ethylene-(meth)acrylic acid ionomer resin having a flexural modulus of 200 to 600 MPa and a Shore D hardness of 50 to 75.

7. The golf ball of claim 1, wherein said layer formed mainly of said thermoplastic polyurethane elastomer further includes at least one resin selected from polyamide elastomers, polyester elastomers, ionomer resins, styrene block elastomers, hydrogenated polybutadiene.

8. The golf ball of claim 1, further comprising diisocyanate included in sadi thermoplastic polyurethane elastomer selected from hexamethylene diisocyanate (HDI), diphenylmethane diisocyanate (MDI) and hydrogenated (MDI) and hydrogenated MDI ($H_{12}$MDI).

9. The golf ball of claim 1, wherein said cover has an overall thickness in the range of 2.0 to 5.5 mm.

10. The golf ball of claim 1, wherein said layer formed of said thermoplastic polyurethane elastomer has a thickness in the range of 0.2 to 3.0 mm.

11. The golf ball of claim 1, wherein said thermoplastic polyurethane elastomer is an innermost layer of said cover and has a thickness in the range of 0.5 to 2.5 mm.

12. The golf ball of claim 1, wherein the other layer of said cover is an ionomer resin having a thickness in the range of 0.2 to 3.2 mm.

* * * * *